US012135195B2

(12) United States Patent
Tervola

(10) Patent No.: US 12,135,195 B2
(45) Date of Patent: Nov. 5, 2024

(54) BALLISTIC SHIELD WITH OFFSET SPACED COMPONENTS FOR IMPROVED PERFORMANCE

(71) Applicant: Timo Olavi Tervola, Jupiter, FL (US)

(72) Inventor: Timo Olavi Tervola, Jupiter, FL (US)

( * ) Notice: Subject to any disclaimer, the term of this patent is extended or adjusted under 35 U.S.C. 154(b) by 0 days.

(21) Appl. No.: 17/981,629

(22) Filed: Nov. 7, 2022

(65) Prior Publication Data

US 2023/0228536 A1 Jul. 20, 2023

Related U.S. Application Data

(60) Provisional application No. 63/276,579, filed on Nov. 6, 2021.

(51) Int. Cl.
*F41H 5/08* (2006.01)
*F41H 5/013* (2006.01)

(52) U.S. Cl.
CPC ..... *F41H 5/08* (2013.01); *F41H 5/013* (2013.01)

(58) Field of Classification Search
CPC ..... F41H 5/08; F41H 5/013
See application file for complete search history.

(56) References Cited

U.S. PATENT DOCUMENTS

2019/0390941 A1* 12/2019 Beck ..... F41H 5/04
2020/0064106 A1* 2/2020 Tervola ..... F41H 5/08
2022/0412690 A1* 12/2022 Daniel ..... F41H 5/08

* cited by examiner

*Primary Examiner* — J. Woodrow Eldred
(74) *Attorney, Agent, or Firm* — Ingram IP Law, P.A.

(57) ABSTRACT

A system is provided with a multi-piece ballistic shield having a primary shield with an outward face exposed to projectiles and an opposing inward face. A first offset layer is mechanically coupled to a first section of the outward face of the primary shield and a second offset layer that is mechanically coupled to a second section of the outward face of the primary shield. The multi-piece ballistic shield further includes a secondary shield that is mechanically coupled to the first offset layer and the second offset layer. The system includes a first handle mechanism mechanically coupled to the inward face and having a fastener secured thereto. The system further includes a harness coupled to the fastener and to a vest shoulder strap to support a weight of the multi-piece ballistic shield.

16 Claims, 7 Drawing Sheets

BALLISTIC SHIELD WITH OFFSET SPACED COMPONENTS FOR IMPROVED PERFORMANCE

CROSS-REFERENCE TO RELATED APPLICATION

This application claims priority to U.S. Provisional Application Ser. No. 63/276,579 filed on Nov. 6, 2021, the complete disclosure of which is incorporated herein by reference in its entirety.

FIELD OF THE TECHNOLOGY

The present technology broadly relates to ballistic shields, more specifically to multi-ply ballistic shields, and still more specifically to multi-layer and multi-ply ballistic shields.

BACKGROUND OF THE TECHNOLOGY

Law enforcement, military, and/or other security forces employ ballistic shields to protect themselves during dangerous situations that may include armed conflict or physical altercations. For example, ballistic shields may be employed to defeat active shooters, serve high-risk warrants, perform riot control, or the like. Ballistic shields may prevent death or injury that may result from being hit with projectiles such as bullets, rocks, bricks, bats, sticks, arrows, or the like.

BRIEF DESCRIPTION OF THE FIGURES

The technology can be more fully understood by reading the following detailed description together with the accompanying drawings, in which like reference indicators are used to designate like elements. The drawings illustrate several examples of the technology. It should be understood, however, that the technology is not limited to the precise arrangements and configurations shown. In the drawings.

DETAILED DESCRIPTION OF THE TECHNOLOGY

Figure 1:
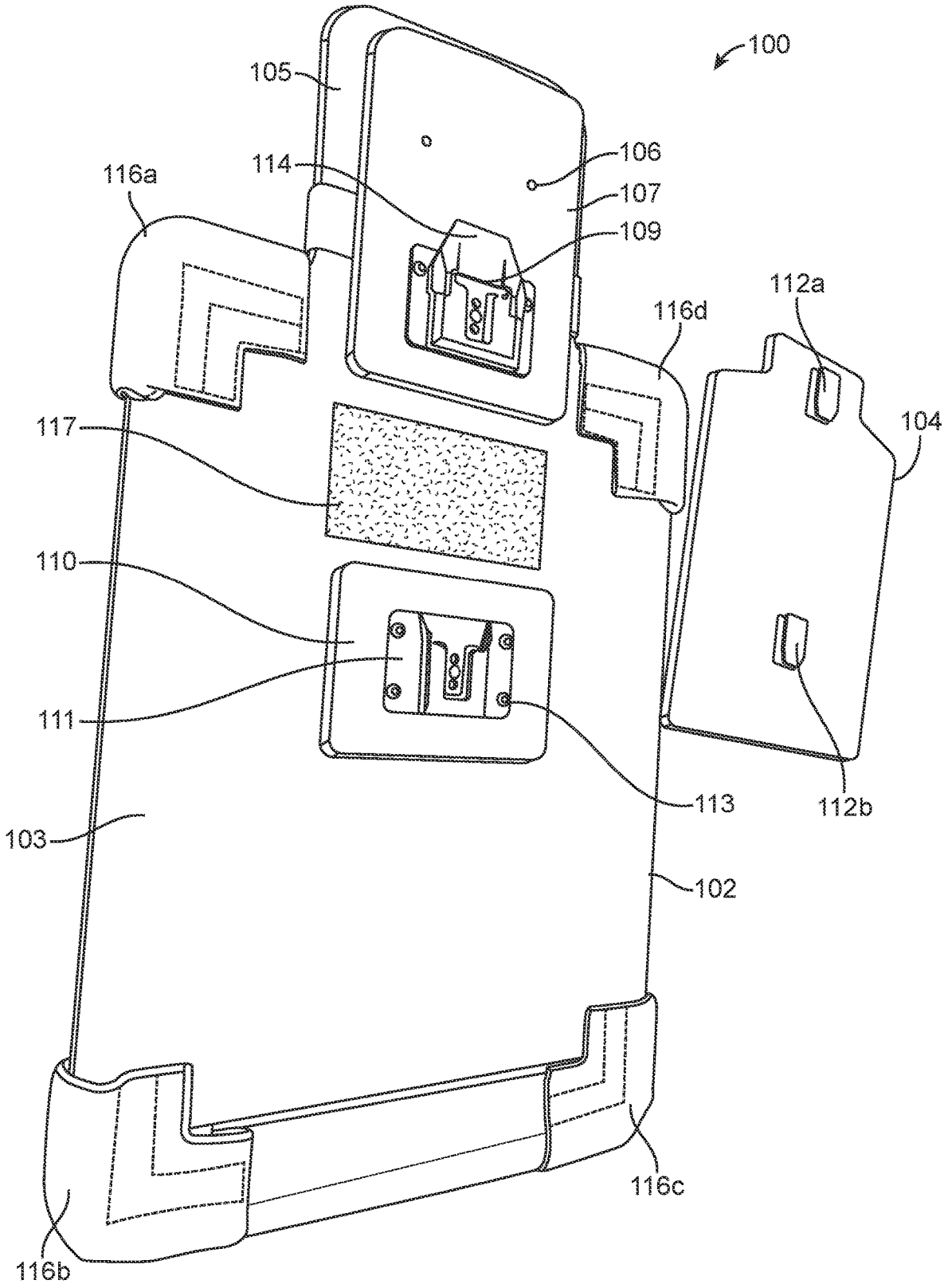
FIG. 1 illustrates a multi-piece ballistic shield having a primary shield depicted in front view and a secondary shield depicted in back view according to one example of the technology.

It will be readily understood by persons skilled in the art that the present disclosure has broad utility and application.

In addition to the specific examples described herein, one of ordinary skill in the art will appreciate that this disclosure supports various adaptations, variations, modifications, and equivalent arrangements.

It will be appreciated that for simplicity and clarity of illustration, where appropriate, reference numerals may be repeated among the different figures to indicate corresponding or analogous elements. In addition, numerous specific details are set forth in order to provide a thorough understanding of the examples described herein. However, it will be understood by those of ordinary skill in the art that the examples described herein may be practiced without these specific details. In other instances, methods, procedures, and components have not been described in detail so as not to obscure the related relevant feature being described. Also, the description is not to be considered as limiting the scope of the examples described herein. The drawings are not necessarily to scale and the proportions of certain parts may have been exaggerated to better illustrate details and features of the present disclosure. Those skilled in the art with access to the teachings provided herein will recognize additional modifications, applications, and examples within the scope thereof and additional fields in which the technology would be of significant utility.

Unless defined otherwise, technical terms used herein have the same meaning as is commonly understood by one of ordinary skill in the art to which this disclosure belongs. The terms "first," "second," and the like, as used herein do not denote any order, quantity, or importance, but rather are used to distinguish one element from another. Also, the terms "a" and "an" do not denote a limitation of quantity, but rather denote the presence of at least one of the referenced items. The term "or" is meant to be inclusive and means either, any, several, or all of the listed items. The terms "comprising," "including," and "having" are used interchangeably in this disclosure. The terms "comprising," "including," and "having" mean to include, but are not necessarily limited to the things so described.

The terms "connected" and "coupled" can be such that the objects are permanently connected or releasably connected. The term "substantially" is defined to be essentially conforming to the thing that it "substantially" modifies, such that the thing need not be exact. For example, substantially 2 inches (2") means that the dimension may include a slight variation.

According to one example, the multi-piece ballistic shield may be constructed from high-strength fibers, epoxy, plastic materials, or the like. According to one example, the multi-piece ballistic shield may be constructed from several layers of high-strength fibers that are mechanically or chemically bonded together. For example, the multi-piece ballistic shield may be constructed from several layers of high strength fibers that are laminated together. According to one example, multiple layers of soft pliable polyethylene film may be formed into a rigid composite ballistic shield or armor panel under extreme pressure and heat. According to one example, a multi-layer ballistic shield may improve ballistic strength based on the existence of molecular or mechanical bonds between individual layers. According to one example, impacting or penetrating projectiles may break molecular bonds when traveling between individual layers. Additionally, or alternatively, the impacting or penetrating projectiles may break mechanical bonds when traveling between individual layers. According to one example, the act of breaking molecular or mechanical bonds between individual layers causes the impacting or penetrating projectiles to dissipate kinetic energy, thereby slowing down.

During a first phase of projectile entry into a ballistic shield, the projectile nose shears or tears several surface layers of the high-strength fibers upon impact, puncturing holes therethrough. According to one example, a high velocity projectile with a small leading surface area causes shearing and puncturing of several layers of high-strength fibers. For example, the penetrating projectile generates frictional forces between the projectile nose and the high-strength fibers that in turn generate thermal energy sufficient to melt or shear the high-strength fibers, forming holes therethrough. According to one example, the ballistic shield is less effective at stopping projectiles during this first phase when layers of the ballistic shield are pierced, rather than separated or delaminated. According to one example, the leading surface area of the armor increases as the projectile nose blunts under the forces of the first phase of projectile entry. This causes the armor to generally deform. For example, the impact forces may blunt the projectile or strip the jacket off the projectile. When the projectile deforms or blunts by a sufficient amount, the high-strength armor fibers may stop shearing. As a result, the projectile may cease shearing or forming holes through the layers of the ballistic shield. According to one example, the first phase of projectile entry may cause minimal layer delamination.

According to one example, a second phase of projectile penetration into the ballistic shield begins when the projectile is sufficiently blunt and includes enough leading surface area to delaminate underlying layers. According to one example, the impacting or penetrating projectiles impart separation forces that delaminate underlying layers. According to one example, the delaminating layers may be physically displaced. For example, the delaminating layers may be physically displaced in lateral or rearward directions, away from a penetrating face of the multi-layer ballistic shield. According to one example, the physically displaced layers may capture the penetrating projectiles within the multi-piece ballistic shield. In other words, the underlying layers form the equivalent of a catcher's mitt to stop the penetrating projectile from advancing through the layers. Stated differently, the penetrating projectiles may be prevented from traveling through layers and exiting the multi-piece ballistic shield.

Figure 6:
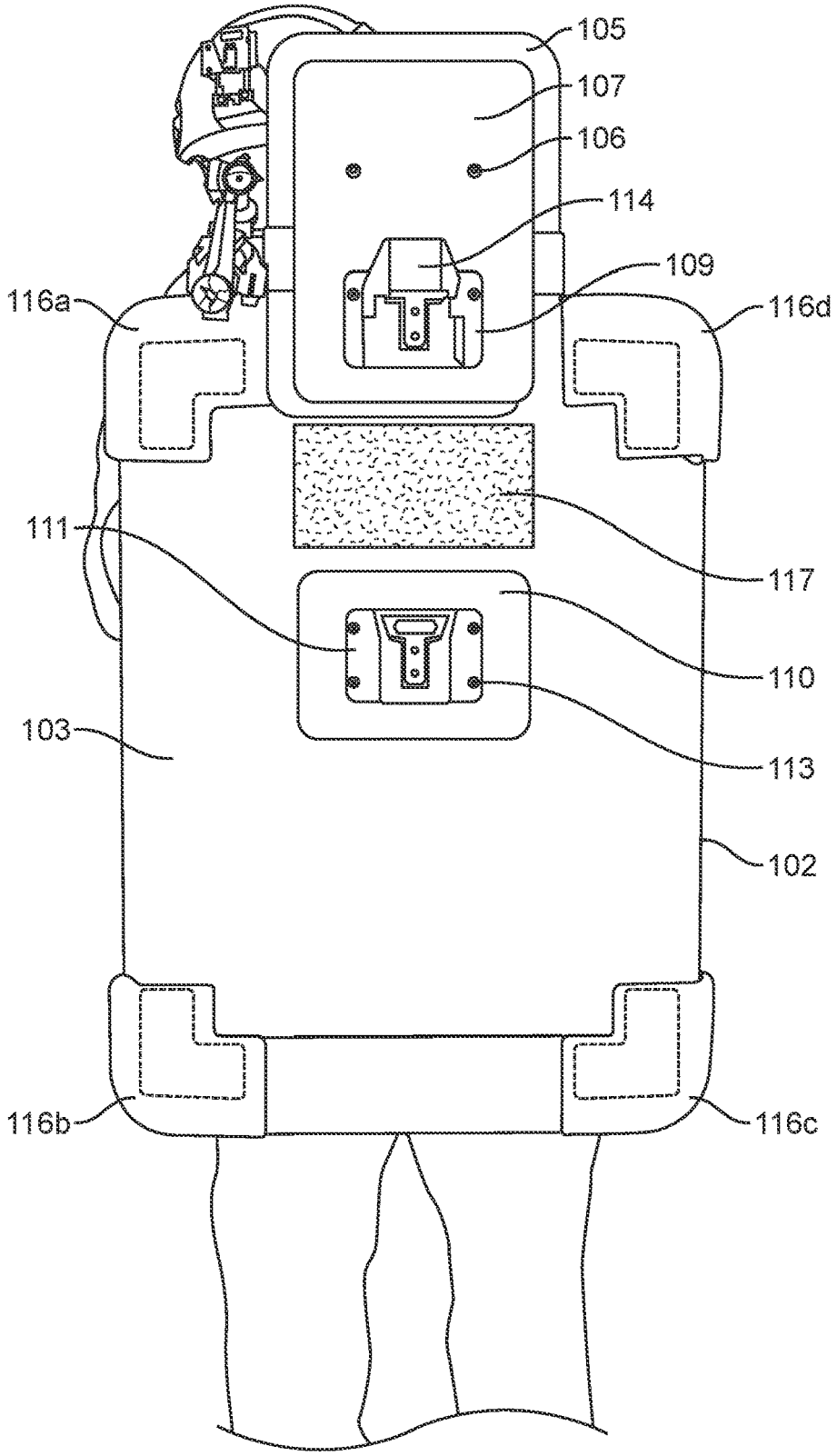
FIG. 6 illustrates a front view of the multi-piece ballistic shield in use, with the secondary shield dismounted from the primary shield, according to one example of the technology.

FIG. 1 illustrates the multi-piece ballistic shield 100 according to one example of the technology. According to one example, the multi-piece ballistic shield 100 includes a primary shield 102 and a secondary shield 104. According to one example, the primary shield 102 may be shaped to correspond to a human body contour. For example, the primary shield 102 may include a large rectangular section 103 with a projecting smaller rectangular section 105. With reference to FIG. 6, the large rectangular section 103 may be dimensioned to protect a human torso. Furthermore, the smaller rectangular section 105 may be dimensioned to protect a human head. According to one example, the primary shield 102 may be of unitary construction. In other words, the primary shield 102 may be constructed of multiple single-pattern fabric layers that are mechanically or chemically bonded together. For example, the primary shield 102 may include a single fabric pattern that is dimensioned to form a shape of the primary shield 102. To be clear, the primary shield 102 may not include a patchwork of fabric patterns that are pieced together to form the shape of the primary shield 102. According to one example, FIG. 1 illustrates a front view or an outward face of the primary shield 102. According to one example, the outward face is exposed to or designed to receive a projectile and is thus termed a penetrating face of the multi-piece ballistic shield 100.

According to one example, the primary shield 102 may include a first offset layer 107 that is mechanically coupled to the smaller rectangular section 105. For example, the first offset layer 107 may be mechanically coupled to the smaller rectangular section 105 using fasteners 106 such as screws, bolts, rivets, or the like. According to one example, an air gap may be provided between the primary shield 102 and the first offset layer 107. According to one example, the air gap may provide an offset between the primary shield 102 and the first offset layer 107. For example, the first offset layer 107 may be perpendicularly or vertically offset from the primary shield 102 via the air gap. Alternatively, the air gap may be eliminated and the first offset layer 107 may directly contact or abut the primary shield 102. According to one example, the first offset layer 107 is positioned to protect the upper body of a user, such as the face and neck. In other words, the first offset layer 107 provides additional protection in key areas as compared to single layer shields. Furthermore, it is contemplated that the user may wear a ballistic helmet or other redundant body armor to protect the head and torso while carrying the multi-piece ballistic shield 100.

According to one example, the first offset layer 107 may completely stop a projectile, leaving the primary shield 102 unaffected. According to another example, a projectile may penetrate through the first offset layer 107 and may enter the air gap with less mass and reduced velocity prior to impacting the primary shield 102. In this case, the first offset layer 107 offers several benefits to the underlying primary shield 102, including a reduced threat of defeating the primary shield 102 and improved shot spacing performance, among other benefits. With respect to the reduced threat of defeating the primary shield 102, the reduced mass and velocity of projectiles that may exit the first offset layer 107 may minimize or prevent the primary shield 102 from experiencing the first phase of projectile entry.

According to one example, shot spacing refers to a physical distance between adjacent projectile impacts. If an area of a shield is compromised due to the first phase of projectile entry or the second phase of projectile penetration, a greater or larger shot spacing is needed to stop a subsequent projectile of equivalent threat. With respect to improving shot spacing performance, the first offset layer 107 may eliminate or significantly reduce exposure of the primary shield 102 to the first phase of projectile entry. Accordingly, the high-strength fibers of the primary shield 102 may avoid being torn or sheared due to the mechanical or thermal processes attributed to a projectile impact as discussed above. Still further, the first offset layer 107 may eliminate or significantly reduce exposure of the primary shield 102 to the second phase of projectile penetration into the ballistic shield 100 as discussed above. With the first offset layer 107 eliminating or significantly reducing exposure of the primary shield 102 to the first phase of projectile entry or the second phase of projectile penetration, the shield design described herein may allow closer shot spacing for subsequent rounds as compared to a ballistic shield without a second or additional layer.

According to one example, the air gap may prevent a projectile or portion of a projectile from penetrating the primary shield 102. For example, if a projectile includes a hardened element within a jacket, the first offset layer 107 may strip the jacket. However, a trajectory of the hardened element may be minimally disturbed and the hardened element may not deform while passing through the first offset layer 107. According to one example, the air gap may enable the hardened element to yaw or tumble upon entering the air gap, prior to impacting the primary shield 102. This change in direction or orientation of the hardened element within the air gap may reduce a threat of the hardened element to the primary shield 102. In other words, the air gap may destabilize a projectile or portion of a projectile prior to impacting the primary shield 102. Still further, the air gap may receive deformed layers therein that originate from the first offset layer 107 such that the deformed layers do not contact the primary shield 102. According to one example, providing an air gap between the primary shield 102 and the first offset layer 107 may enable manufacturing of the shield components with a reduced number of layers as compared to a shield without an air gap. This may result in a shield having reduced thickness and weight as compared to a shield without an air gap. One of ordinary skill in the art will readily appreciate that the primary shield 102 and the first offset layer 107 may be mechanically coupled without an air gap therebetween. However, omitting the air gap between the primary shield 102 and the first offset layer 107 may require the shield components to be manufactured with increased thickness to provide equivalent performance to a shield having an air gap. According to one example, a fastening mechanism 109 may be affixed to the first offset layer 107 to releasably secure the secondary shield 104.

According to one example, the primary shield 102 may include a second offset layer 110 that is mechanically coupled to the large rectangular section 103. For example, the second offset layer 110 may be mechanically coupled to the large rectangular section 103 using fasteners 113 such as screws, bolts, rivets, or the like. According to one example, an air gap may be provided between the primary shield 102 and the second offset layer 110. According to one example, the air gap may provide an offset between the primary shield 102 and the second offset layer 110. For example, the second offset layer 110 may be vertically offset from the primary shield 102 via the air gap. Alternatively, the air gap may be eliminated and the second offset layer 110 may directly contact or abut the primary shield 102. According to one example, the second offset layer 110 is positioned to protect the mid-section of a user, such as the abdomen.

According to one example, the second offset layer 110 may completely stop a projectile, leaving the primary shield unaffected. According to another example, a projectile may penetrate through the second offset layer 110 and may enter the air gap with less mass and reduced velocity prior to impacting the primary shield 102. In this case, the second offset layer 110 offers several benefits to the underlying primary shield 102, including a reduced threat of defeating the primary shield 102 and improved shot spacing performance, among other benefits. With respect to the reduced threat of defeating the primary shield 102, the reduced mass and velocity of projectiles that may exit the second offset layer 110 may minimize or prevent the primary shield 102 from experiencing the first phase of projectile entry.

With respect to improved shot spacing performance, the second offset layer 110 may eliminate or significantly reduce exposure of the primary shield 102 to the first phase of projectile entry. Accordingly, the high-strength fibers of the primary shield 102 may avoid being torn or sheared due to the mechanical or thermal processes attributed to a projectile impact as discussed above. Still further, the second offset layer 110 may eliminate or significantly reduce exposure of the primary shield 102 to the second phase of projectile penetration into the ballistic shield as discussed above. With the second offset layer 110 eliminating or significantly reducing exposure of the primary shield 102 to the first phase of projectile entry or the second phase of projectile penetration, the shield design described herein may allow closer shot spacing for subsequent rounds as compared to a ballistic shield without a second or additional layer.

According to one example, the air gap may prevent a projectile or portion of a projectile from penetrating the primary shield 102. For example, if a projectile includes a hardened element within a jacket, the second offset layer 110 may strip the jacket. However, a trajectory of the hardened element may be minimally disturbed and the hardened element may not deform while passing through the second offset layer 110. According to one example, the air gap may enable the hardened element to yaw or tumble upon entering the air gap, prior to impacting the primary shield 102. This change in direction or orientation of the hardened element within the air gap may reduce a threat of the hardened element to the primary shield 102. In other words, the air gap may destabilize a projectile or portion of a projectile prior to impacting the primary shield 102. Still further, the air gap may receive deformed layers therein that originate from second offset layer 110 such that the deformed layers do not contact the primary shield 102. According to one example, providing an air gap between the primary shield 102 and the second offset layer 110 may enable manufacturing of the shield components with a reduced number of layers as compared to a shield without an air gap. This may result in a shield having reduced thickness and weight as compared to a shield without an air gap. One of ordinary skill in the art will readily appreciate that the primary shield 102 and the second offset layer 110 may be mechanically coupled without an air gap therebetween. However, omitting the air gap between the primary shield 102 and the second offset layer 110 may require the shield components to be manufactured with increased thickness to provide equivalent performance to a shield having an air gap. According to one example, a fastening mechanism 111 may be affixed to the second offset layer 110 to releasably secure the secondary shield 104.

Figure 2:
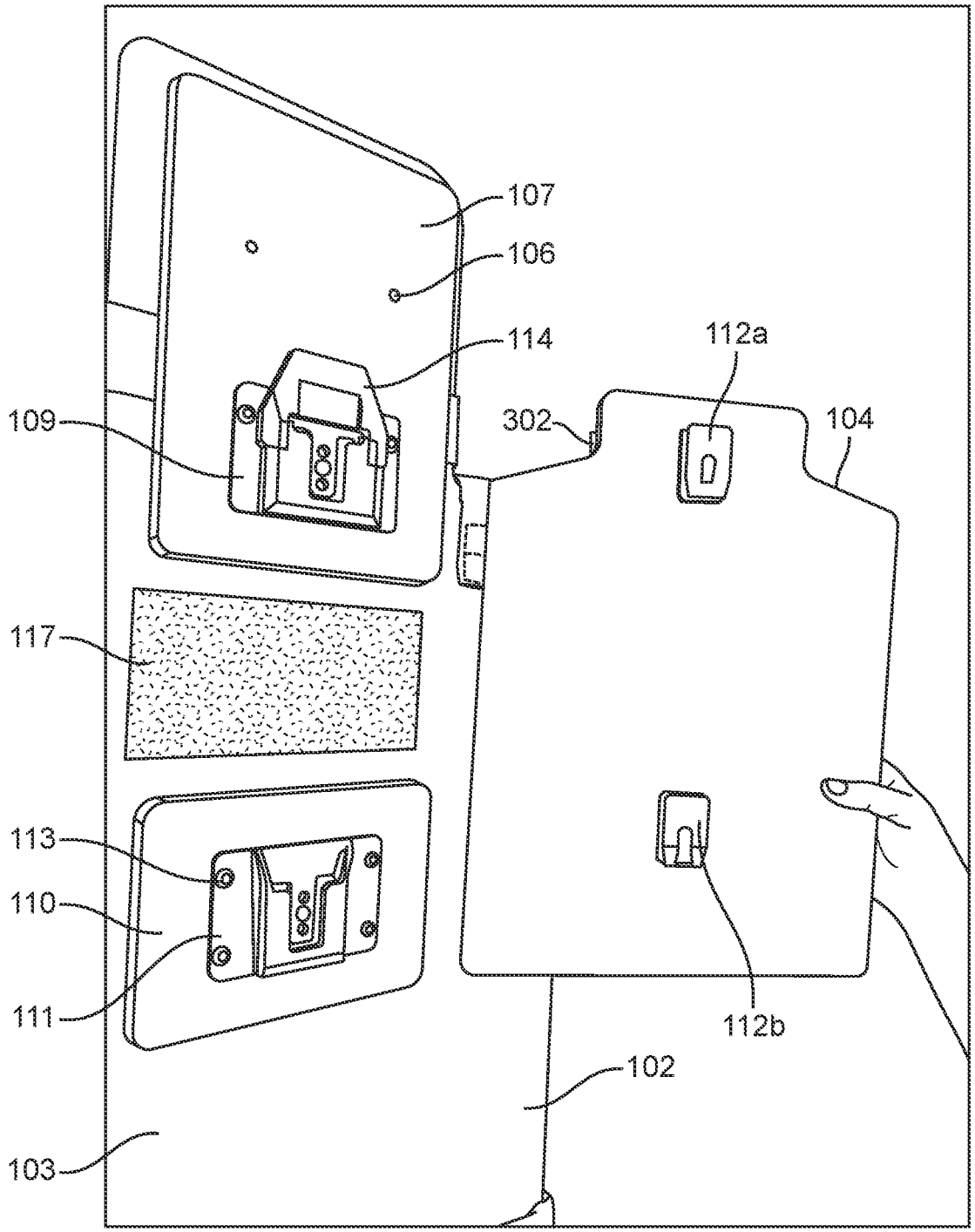
FIG. 2 illustrates a magnified view of the multi-piece ballistic shield with a fastening mechanism that mechanically couples the primary and secondary shields according to one example of the technology.

According to one example, the secondary shield 104 may include clips 112*a*,112*b* that releasably engage corresponding fastening mechanisms 109,111. According to one example, the fastening mechanism 109 may include a release mechanism 114 that is actuated to release the secondary shield 104. FIG. 1 further illustrates pads 116*a*-116*d* that may be applied to edges of the primary shield 102. According to one example, the pads 116*a*-116*d* may protect edges of the multi-piece ballistic shield 100 from becoming damaged. Alternatively, or additionally, the pads 116*a*-116*d* may protect users of the multi-piece ballistic shield 100 from becoming injured. According to one example, a hook and loop patch 117 may be provided on the primary shield 102. For example, the hook and loop patch 117 may be provided on the outward face of the primary shield 102. FIG. 2 illustrates a magnified view of the multi-piece ballistic shield 100 having the fastening mechanisms 109,111 that releasably engage corresponding clips 112*a*,112*b* to releasably secure the secondary shield 104 according to one example of the technology.

Figure 3:
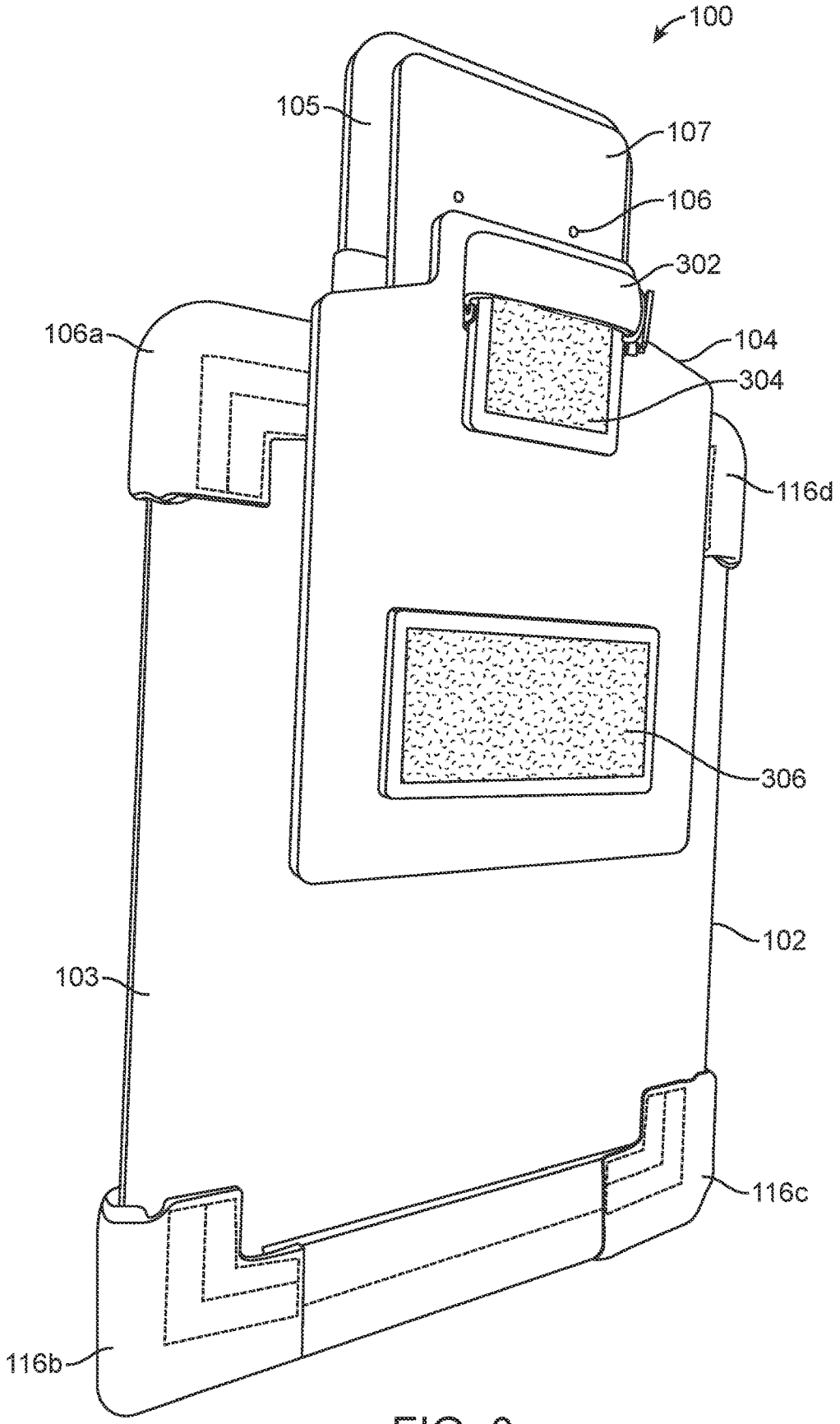
FIG. 3 illustrates the multi-piece ballistic shield with the primary and secondary shields depicted in front view, the rear side of the secondary shield being mechanically coupled to the front side of the primary shield according to one example of the technology.
Figure 7:
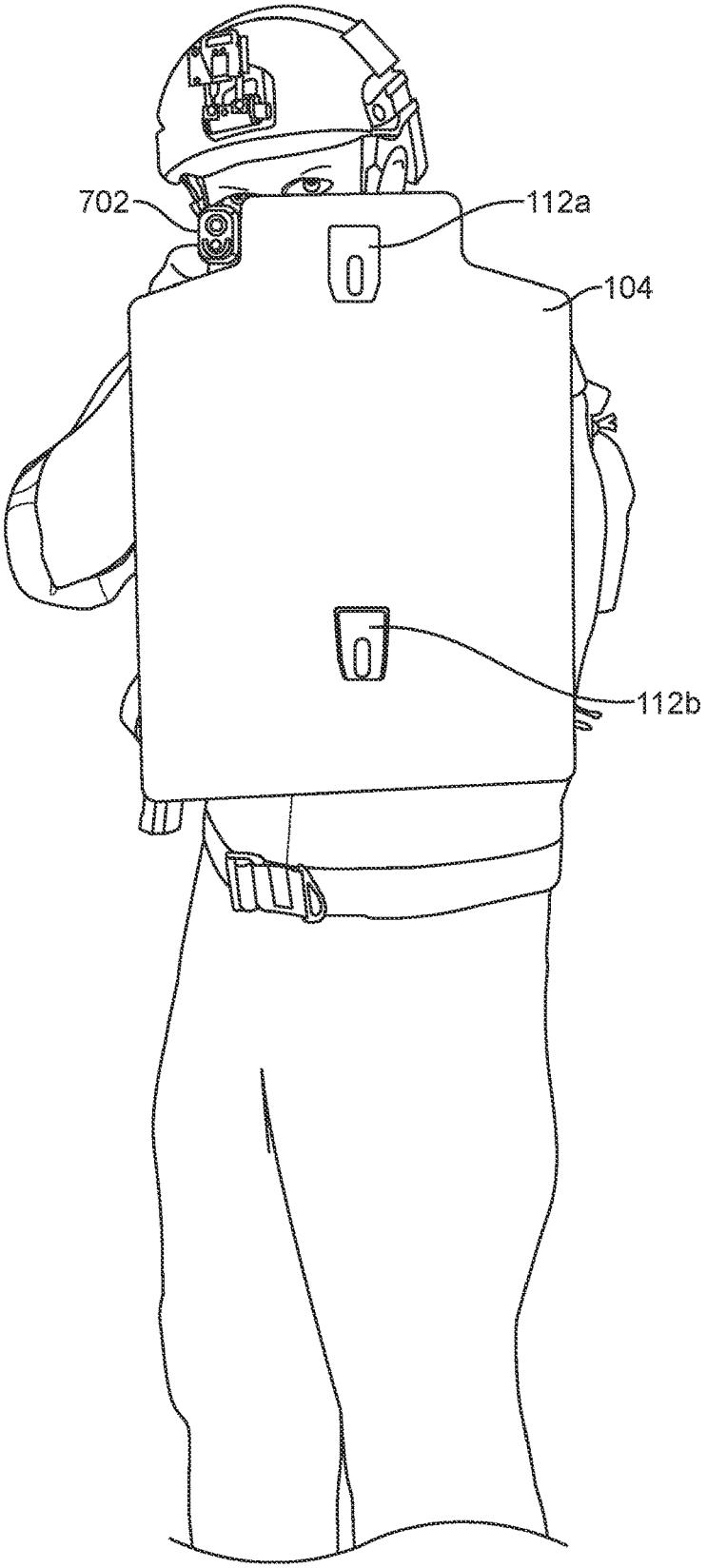
FIG. 7 illustrates a front view of the secondary shield in use according to one example of the technology.

FIG. 3 illustrates the primary shield 102 and the secondary shield 104 affixed together according to one example of the technology. According to one example, the secondary shield 104 may include a strap 302, along with padded hook and loop patches 304,306. According to one example, users may employ the strap 302 to grip the secondary shield 104. For example, users may employ the strap 302 to grip the secondary shield 104 while separating the secondary shield 104 from the primary shield 102. Furthermore, users may employ the strap 302 to grip the secondary shield 104 when it is carried alone as illustrated in FIG. 7. According to one example, the padded hook and loop patch 304 may be employed to cushion a contact point with a back of a user's hand when the strap 302 is gripped during use. According to one example, the padded hook and loop patch 306 may be employed to cushion a contact point with a user's forearm when the strap 302 is gripped during use.

FIG. 3 illustrates that the multi-piece ballistic shield 100 may include strategic sections with multi-stacked layers. According to one example, the strategic sections may be selected to protect vital organs. For example, the multi-stacked layers may be situated to protect vital organs located in the mid-section or upper body such as the head, heart, lungs, abdomen, or the like. According to one example, the multi-piece ballistic shield 100 may include strategic sections that include triple stacked layers. For example, a first layer may be defined by the primary shield 102, a second layer may be defined by the first and second offset layers 107,110, and a third layer may be defined by the secondary shield 104. According to one example, air gaps may be provided between stacked or adjacent layers. Accordingly, two air gaps may be provided for a triple stacked layer. One of ordinary skill in the art will readily appreciate that a greater number or a fewer number of stacked layers may be employed. Furthermore, one of ordinary skill in the art will readily appreciate that air gaps may be omitted between stacked layers.

Figure 4:
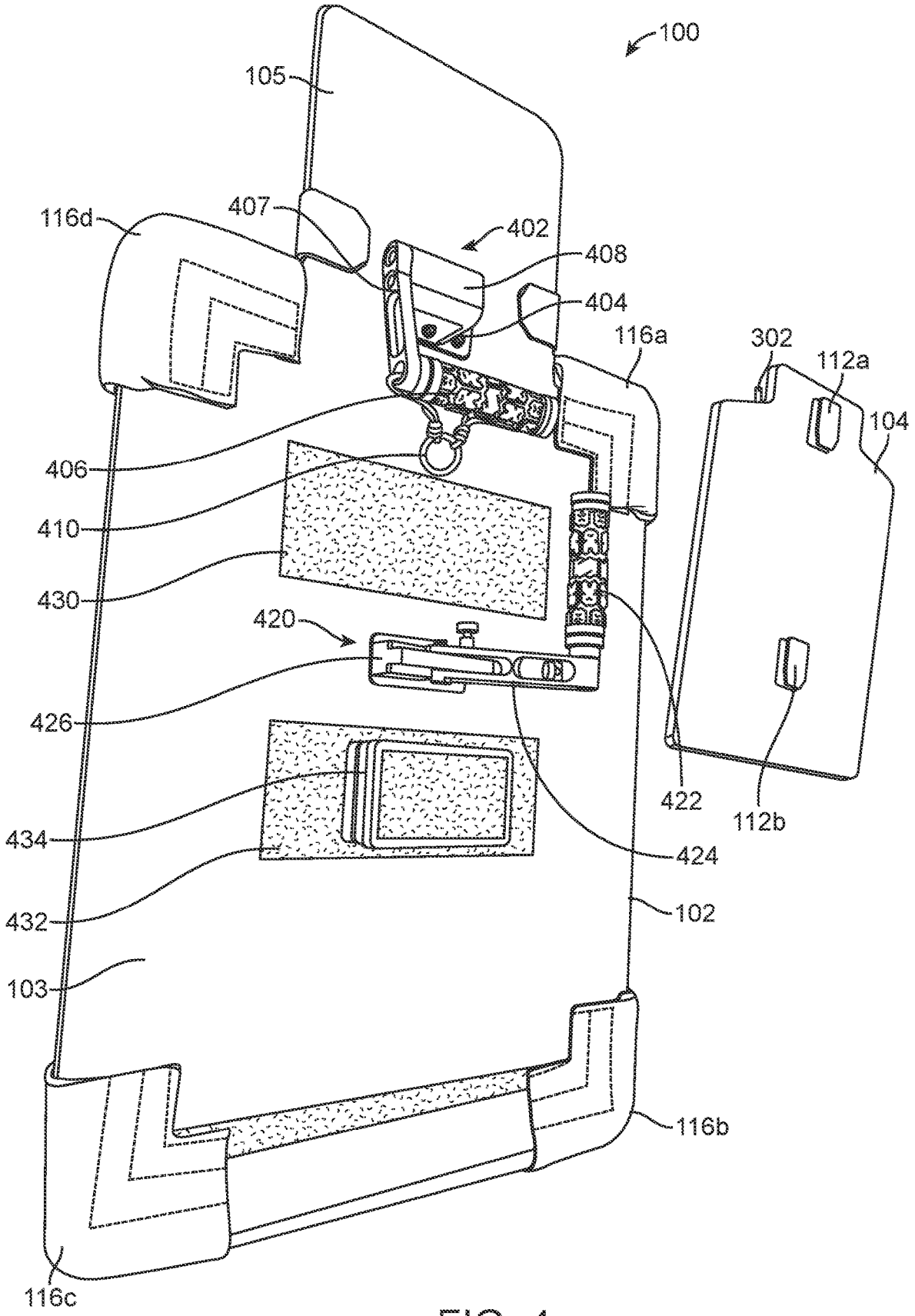
FIG. 4 illustrates the multi-piece ballistic shield with the primary and secondary shields depicted in back view according to one example of the technology.

FIG. 4 illustrates the multi-piece ballistic shield 100 with the primary and secondary shields depicted in back view according to one example of the technology. According to one example, the primary shield 102 may include a first handle mechanism 402 that is mechanically coupled at or proximate to the small rectangular section 105. For example, the first handle mechanism 402 may be mechanically coupled at or proximate to the small rectangular section 105 using fasteners 404 such as screws, bolts, rivets, or the like. According to one example, the first handle mechanism 402 may directly abut the primary shield 102. According to one example, the first handle mechanism 402 may include a first grip 406. According to one example, the first handle mechanism 402 may include a first arm 407 that pivots at a base 408 to fixedly secure the first grip 406 in one of various positions. For example, FIG. 4 illustrates the first grip 406 fixedly secured in a downward position. According to one example, the first arm 407 may pivot at the base 408 to fixedly secure the first grip 406 in a substantially perpendicular orientation relative to the primary shield 102. Furthermore, the first arm 407 may pivot at the base 408 to fixedly secure the first grip 406 in an upward position. Still further, the first arm 407 may pivot at the base 408 to fixedly secure the first grip 406 in any position between the upward and downward positions. According to one example, a fastener 410 may be secured to the first handle mechanism 402. For example, the fastener 410 may be secured to the first grip 406 in order to secure a harness thereto as described below. According to one example, the fastener 410 may include a ring or the like. One of ordinary skill in the art will readily appreciate that the first arm 407 may be provided at opposite sides of the base 408 to accommodate left-handed or right-handed users.

According to one example, the primary shield 102 may include a second handle mechanism 420 that is mechanically coupled to the large rectangular section 103. For example, the second handle mechanism 420 may be mechanically coupled to the large rectangular section 103 using fasteners such as screws, bolts, rivets, or the like. According to one example, the second handle mechanism 420 may directly abut the primary shield 102. According to one example, the second handle mechanism 420 may include a second grip 422. According to one example, the second handle mechanism 420 may include a second arm 424 that pivots at a base 426 to fixedly secure the second grip 422 in one of various positions. For example, FIG. 4 illustrates the second grip 422 fixedly secured in a rightward position. According to one example, the second arm 424 may pivot at the base 426 to fixedly secure the second grip 422 in a substantially perpendicular orientation relative to the primary shield 102. Furthermore, the second arm 424 may pivot at the base 426 to fixedly secure the second grip 422 in a leftward position. Still further, the second arm 424 may pivot at the base 426 to fixedly secure the second grip 422 in any position between the rightward and leftward positions. One of ordinary skill in the art will readily appreciate that the second arm 424 may be inverted such that the second grip 422 is directed downward rather than upward as depicted in FIG. 4. Still further, the second arm 424 may be removed to provide a different mode of use.

According to one example, hook and loop patches 430, 432 may be provided on the primary shield 102. For example, the hook and loop patches 430,432 may be provided on an inward face of the primary shield 102. According to one example, risers 434 may be stacked on the hook and loop patches 430,432 to elevate a contact point relative to a surface of the primary shield 102. For example, the risers 434 maybe stacked on the hook and loop patches 430, 432 to elevate the contact point such that a user's body part may comfortably engage the primary shield 102 during use. Still further, the risers 434 may provide padding to users.

Figure 5:
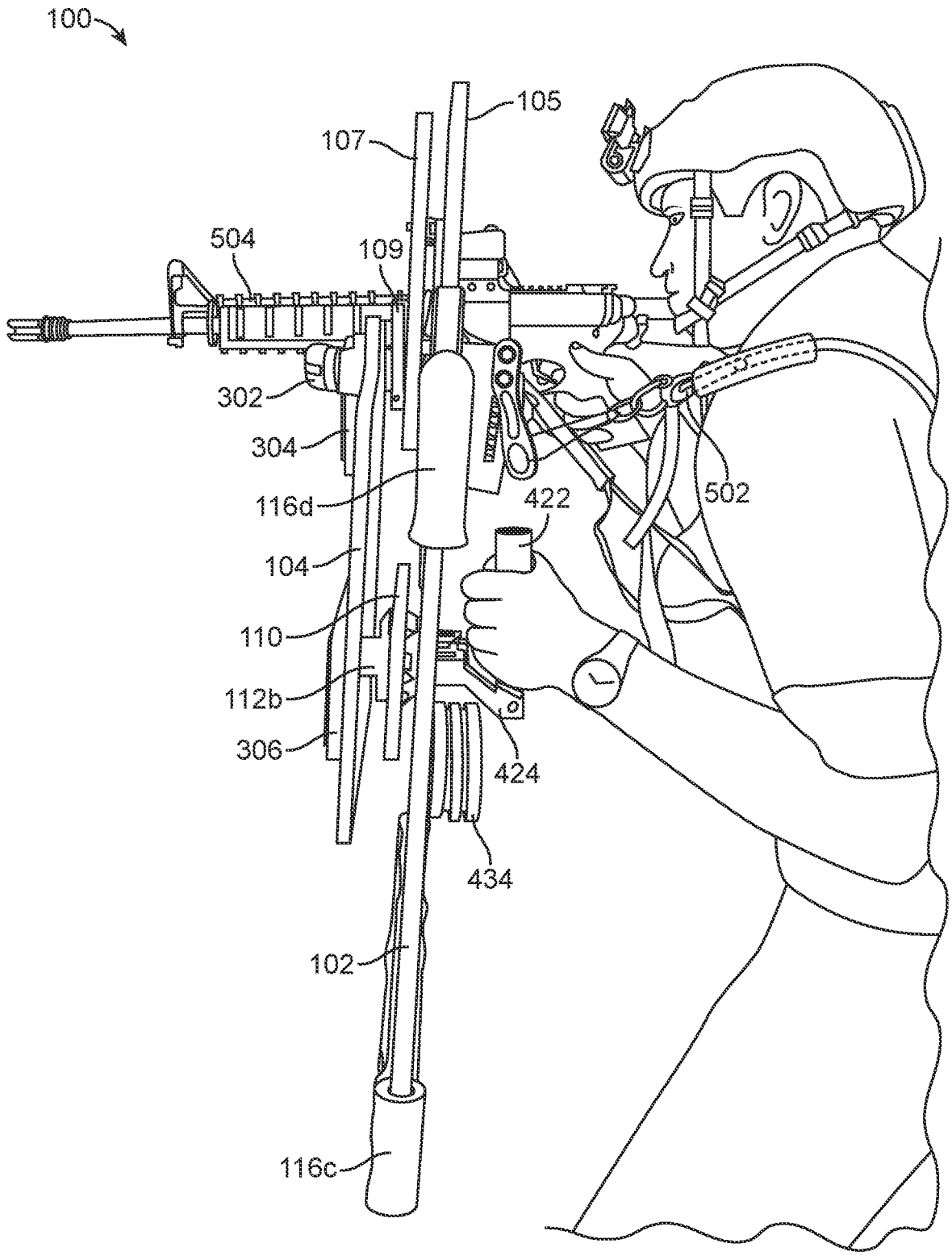
FIG. 5 illustrates a side view of the multi-piece ballistic shield in use, with the secondary shield mounted on the primary shield, according to one example of the technology.

FIG. 5 illustrates a side view of the multi-piece ballistic shield 100 in use according to one example of the technology, with the secondary shield 104 mounted on the primary shield 102. According to one example, the multi-piece ballistic shield 100 includes the fastener 410 that may be mounted to the upper grip 406 as illustrated in FIG. 4. According to one example, a harness 502 may be secured to a vest shoulder strap and may clip to the fastener 410 to support a majority of the weight attributed to the multi-piece ballistic shield 100. According to one example, the user may rest a firearm 504 on the pad 116*a* of the multi-piece ballistic shield 100 as illustrated in FIG. 6. According to one example, the user may grasp the lower grip 422 with a free hand to maneuver the multi-piece ballistic shield 100. For example, the user may maneuver the multi-piece ballistic shield 100 to position the firearm 504 a comfortable distance relative to the user's body. According to one example, a comfortable distance may allow the user to aim and discharge the firearm 504 with desired accuracy. One of ordinary skill in the art will readily appreciate that a user may be left-handed and thus may rest the firearm 504 on the pad 116*d* of the multi-piece ballistic shield 100. In this case, the user may grasp the lower grip 422 with a right hand to maneuver the multi-piece ballistic shield 100 a comfortable distance relative to the user's body to aim and discharge the firearm 504 with desired accuracy. FIG. 6 illustrates a front view of the multi-piece ballistic shield 100 in use according to one example of the technology, with the secondary shield 104 dismounted from the primary shield 102.

FIG. 7 illustrates a front view of the secondary shield 104 in use according to one example of the technology. According to one example, the secondary shield 104 may be deployed in situations that offer limited physical space. For example, the secondary shield 104 may be deployed in situations where a fugitive enters an attic or other tight space. According to one example, the user may pursue a suspect with the multi-piece ballistic shield 100 and may detach the secondary shield 104 from the primary shield 102 when warranted by combat conditions. When the user transitions to the secondary shield 104, the user also may transition to a pistol 702 for close quarter combat.

According to one example, the primary and second shields 102,104, along with the first and second offset layers 107,110, may be constructed from ultra-high-molecular-weight polyethylene ("UEMWPE"). UEMWPE is a subset of thermoplastic polyethylene and has extremely long chains that transfer load more effectively to the polymer backbone by strengthening intermolecular interactions. This results in a very tough material, with the highest impact strength of any thermoplastic polyethylene. For personal armor, the fibers may be aligned and bonded into sheets that are layered at various angles to give the resulting composite material strength in all directions. A completed multi-piece ballistic shield 100 may include a range of layer counts and layer thicknesses, both for individual layers and a total finished product. According to one example, the thickness of the finished product may depend upon the desired ballistic capabilities and the type of raw ballistic material employed. Generally, for rifle threats, a total product thickness may range from 5 millimeters to 15 millimeters thick and may vary from 60 layers to 120 layers thick. One of ordinary skill in the art will readily appreciate that total product thickness and the layer count may be reduced for handgun threats. According to one example, the primary shield 102 may be constructed from 100 ply sheets or greater. According to one example, the secondary shield 104 and first and second offset layers 107,110 may be constructed from 90 ply sheets or greater. According to one example, the multi-layer ballistic shield improves ballistic strength and a weight or density to performance ratio. According to one example, the multi-stacked layers and configuration of the multi-piece ballistic shield 100 described herein allow it to defeat 5.56×45 mm M855 green tip rounds.

While the foregoing illustrates and describes examples of this technology, it is to be understood that the technology is not limited to the constructions disclosed herein. The technology may be embodied in other specific forms without departing from its spirit. Accordingly, the appended claims are not limited by specific examples described herein.

What is claimed is:

1. A multi-piece ballistic shield, comprising:

a primary shield having an outward face exposed to projectiles and an opposing inward face;

a first vertical offset layer that is mechanically coupled to a first section of the outward face of the primary shield, wherein the first vertical offset layer is offset by an air gap from the primary shield; and a second vertical offset layer that is mechanically coupled to a second section of the outward face of the primary shield.

2. The multi-piece ballistic shield according to claim 1, wherein the first section is dimensioned to protect a human torso and the second section is dimensioned to protect a human head.

3. A multi-piece ballistic shield, comprising:

a primary shield having an outward face exposed to projectiles and an opposing inward face;

a first vertical offset layer that is mechanically coupled to a first section of the outward face of the primary shield; and a second vertical offset layer that is mechanically coupled to a second section of the outward face of the primary shield, wherein the second vertical offset layer is offset by an air gap from the primary shield.

4. A multi-piece ballistic shield, comprising:

a primary shield having an outward face exposed to projectiles and an opposing inward face;

a first vertical offset layer that is mechanically coupled to a first section of the outward face of the primary shield;

a second vertical offset layer that is mechanically coupled to a second section of the outward face of the primary shield; and a secondary shield that is mechanically coupled to the first vertical offset layer and the second vertical offset layer, wherein the secondary shield is offset by two air gaps from the primary shield and by one air gap from at least one of the first vertical offset layer or the second vertical offset layer.

5. The multi-piece ballistic shield according to claim 4, further comprising four or more vertically stacked layers including the primary shield, the first vertical offset layer, the second vertical offset layer, and the secondary shield.

6. The multi-piece ballistic shield according to claim 1, further comprising a first handle mechanism mechanically coupled to the inward face, the first handle mechanism having a first arm that pivots at a base to fixedly secure a first grip in one of various positions.

7. The multi-piece ballistic shield according to claim 6, further comprising a second handle mechanism mechanically coupled to the inward face, the second handle mechanism having a second arm that pivots at a base to fixedly secure a second grip in one of various positions.

8. The multi-piece ballistic shield according to claim 4, wherein at least one of the primary shield, the first vertical offset layer, the second vertical offset layer, or the secondary shield are constructed from ultra-high-molecular-weight polyethylene.

9. A system, comprising:

a multi-piece ballistic shield, having:

a primary shield having an outward face exposed to projectiles and an opposing inward face;

a first vertical offset layer that is mechanically coupled to a first section of the outward face of the primary shield, wherein the first vertical offset layer is offset by an air gap from the primary shield; and a second vertical offset layer that is mechanically coupled to a second section of the outward face of the primary shield;

a first handle mechanism mechanically coupled to the inward face;

a fastener secured to the first handle mechanism; and a harness coupled to the fastener and a vest shoulder strap to support a weight of the multi-piece ballistic shield.

10. The system according to claim 9, wherein the first section is dimensioned to protect a human torso and the second section is dimensioned to protect a human head.

11. A system, comprising:

a multi-piece ballistic shield, having:

a primary shield having an outward face exposed to projectiles and an opposing inward face;

a first vertical offset layer that is mechanically coupled to a first section of the outward face of the primary shield; and a second vertical offset layer that is mechanically coupled to a second section of the outward face of the primary shield, wherein the second vertical offset layer is offset by an air gap from the primary shield;

a first handle mechanism mechanically coupled to the inward face;

a fastener secured to the first handle mechanism; and a harness coupled to the fastener and a vest shoulder strap to support a weight of the multi-piece ballistic shield.

12. A system, comprising:

a multi-piece ballistic shield, having:

a primary shield having an outward face exposed to projectiles and an opposing inward face;

a first vertical offset layer that is mechanically coupled to a first section of the outward face of the primary shield;

a second vertical offset layer that is mechanically coupled to a second section of the outward face of the primary shield; and a secondary shield that is mechanically coupled to the first vertical offset layer and the second vertical offset layer, wherein the secondary shield is offset by two air gaps from the primary shield and by one air gap from at least one of the first vertical offset layer or the second vertical offset layer;

a first handle mechanism mechanically coupled to the inward face;

a fastener secured to the first handle mechanism; and a harness coupled to the fastener and a vest shoulder strap to support a weight of the multi-piece ballistic shield.

13. The system according to claim 12, wherein the multi-piece ballistic shield further comprises four or more vertically stacked layers including the primary shield, the first vertical offset layer, the second vertical offset layer, and the secondary shield.

14. The system according to claim 9, wherein the first handle mechanism includes a first arm that pivots at a base to fixedly secure a first grip in one of various positions.

15. The system according to claim 14, further comprising a second handle mechanism mechanically coupled to the inward face, the second handle mechanism having a second arm that pivots at a base to fixedly secure a second grip in one of various positions.

16. The system according to claim 12, wherein at least one of the primary shield, the first vertical offset layer, the second vertical offset layer, or the secondary shield are constructed from ultra-high-molecular-weight polyethylene.

* * * * *